US007357090B2

(12) United States Patent
Spade et al.

(10) Patent No.: US 7,357,090 B2
(45) Date of Patent: Apr. 15, 2008

(54) PERSONAL WATERCRAFT HAVING A POLE SUPPORT

(75) Inventors: Sam Spade, Palm Bay, FL (US); Daniel Ferland, Bromont (CA); John Huberty, Palm Bay, FL (US)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 11/380,330

(22) Filed: Apr. 26, 2006

(65) Prior Publication Data

US 2007/0034128 A1 Feb. 15, 2007

Related U.S. Application Data

(60) Provisional application No. 60/674,701, filed on Apr. 26, 2005.

(51) Int. Cl.
*B63B 35/73* (2006.01)

(52) U.S. Cl. ..... 114/55.52; 114/55.56

(58) Field of Classification Search ..... 114/55.5, 114/55.52, 55.56, 55.57, 144 R; 188/300
See application file for complete search history.

(56) References Cited

U.S. PATENT DOCUMENTS

| | | | | |
|---|---|---|---|---|
| 3,158,129 | A | 11/1964 | Mauer | |
| 3,483,844 | A | 12/1969 | Trautwein | |
| 3,948,206 | A | 4/1976 | Tyler | |
| 4,733,627 | A | 3/1988 | Nishida | |
| 4,989,532 | A | 2/1991 | Kishi et al. | |
| 5,056,450 | A | 10/1991 | Mardikian | |
| 5,103,754 | A | 4/1992 | Fujitsubo | |
| 5,113,777 | A | 5/1992 | Kobayashi | |
| 5,377,609 | A | 1/1995 | Miller | |
| 5,542,371 | A | 8/1996 | Harvey et al. | |
| 5,542,862 | A | 8/1996 | Kobayashi | |
| 5,622,132 | A | 4/1997 | Mardikian | |
| 6,019,054 | A | 2/2000 | Hattori et al. | |
| 6,021,734 | A * | 2/2000 | Sperberg | 114/363 |
| 6,152,062 | A | 11/2000 | Hattori | |
| 7,004,091 | B2 | 2/2006 | Adamczyk | |
| 2004/0003767 | A1 * | 1/2004 | Adamczyk et al. | 114/363 |

FOREIGN PATENT DOCUMENTS

| | | | |
|---|---|---|---|
| JP | 403176295 | * | 7/1991 |

OTHER PUBLICATIONS

Translation of JP 3-176295.*

* cited by examiner

*Primary Examiner*—Sherman Basinger
(74) *Attorney, Agent, or Firm*—Osler, Hoskin & Harcourt LLP

(57) ABSTRACT

A personal watercraft has a pole having a forward portion pivotally connected to the deck. Handlebars are operatively connected to the rearward portion of the pole. A pole support is connected to the pole at one end and to the deck at the other in order to support the pole above the deck. The pole support is preferably connected to the pole and the deck with latches. The length of the pole support can be adjusted in order to accommodate different sizes of riders.

7 Claims, 11 Drawing Sheets

PERSONAL WATERCRAFT HAVING A POLE SUPPORT

CROSS-REFERENCE

The present application claims priority to U.S. Provisional Application No. 60/674,701, entitled "Watercraft Steering Support", filed Apr. 26, 2005, the entirety of which is incorporated herein by reference.

FIELD OF THE INVENTION

The present invention relates to a personal watercraft having a pole support to support a pole of the personal watercraft above the deck thereof.

BACKGROUND OF THE INVENTION

There exist two main types of personal watercraft: the runabout and the stand-up. Runabout personal watercraft have a straddle seat and steering handlebars affixed to the deck. Stand-up personal watercraft do not have a seat. Instead, they are provided with a standing surface on which a rider stands or kneels to operate the watercraft. The steering handlebars of stand-up personal watercraft are connected to a pole which pivots relative to the deck about a horizontal axis. Stand-up personal watercraft are also generally narrower than runabout personal watercraft, which makes them more manoeuvrable, but also less stable, than runabout personal watercraft.

Due to the above-mentioned characteristics of stand-up personal watercraft, it is more difficult and physically demanding to ride a stand-up personal watercraft than a runabout personal watercraft.

One solution to this problem consists in supporting the pole above the deck, thus allowing riders to use the handlebars mounted to the pole as a support.

However, as riders become more experienced, they may no longer need a device providing this function. Also, a single stand-up watercraft may be used by more than one person, only some of whom may require such a device, and others not. Furthermore, some riders may like to use such a device only when the riding conditions are more difficult, such as in wavy water.

Therefore, there exists a need for a device which supports the pole above the deck and can easily be connected to and removed from a stand-up personal watercraft.

As mentioned above, a single stand-up watercraft may be used by more than one person. A device supporting the pole should therefore accommodate various sizes of rider.

Therefore, there exists a need for a device which supports the pole above the deck and can be adjusted to accommodate various sizes of rider.

Also, there exists a need for a device which provides sufficient support for the pole regardless of the adjustment made to the device.

STATEMENT OF THE INVENTION

One aspect of the invention provides a personal watercraft having a pole support to support a pole of the watercraft above the deck. The pole support is connected to the pole at one end thereof and to the deck at the other.

Another aspect of the invention provides a personal watercraft having a pole support which is latched to a pole of the watercraft at one end and to the deck of the watercraft at the other.

Yet another aspect of the invention provides a personal watercraft having a pole support to support a pole of the watercraft above the deck and having an adjustable length.

In another aspect, the invention provides a personal watercraft having a hull, a deck disposed on the hull, an engine disposed between the hull and the deck, and a pole. The pole has a forward portion and a rearward portion. The forward portion of the pole is pivotally connected to the deck about a substantially horizontal axis. Handlebars are operatively connected to the rearward portion of the pole for steering the watercraft. A pole support is provided to support the rearward portion of the pole above the deck. The pole support has a first end connected to the rearward portion of the pole, and a second end connected to the deck. The pole support is generally vertical when the personal watercraft is level regardless of the position of the pole.

For purposes of this application, the term "level" refers to the attitude of the personal watercraft when it is not moving, is in still water, and no load, such as the weight of a rider, is being applied to it.

In another aspect, the invention provides a personal watercraft having a hull, a deck disposed on the hull, an engine disposed between the hull and the deck, and a pole. The pole has a forward portion and a rearward portion. The forward portion of the pole is pivotally connected to the deck about a substantially horizontal axis. Handlebars are operatively connected to the rearward portion of the pole for steering the watercraft. A pole is provided to support the rearward portion of the pole above the deck. The pole support has a first end and a second end. A first latch is provided for connecting the first end of the pole support to the pole. A second latch is provided for connecting the second end of the pole support to the deck.

In yet another aspect, the invention provides a personal watercraft having a hull, a deck disposed on the hull, an engine disposed between the hull and the deck, and a pole. The pole has a forward portion and a rearward portion. The forward portion of the pole is pivotally connected to the deck about a substantially horizontal axis. Handlebars are operatively connected to the rearward portion of the pole for steering the watercraft. A pole support is provided to support the rearward portion of the pole above the deck. The pole support has a first end connected to the pole, a second end connected to the deck, a first tube, and a second tube. One of the first tube and the second tube sliding inside the other of the first tube and the second tube to permit adjustment of a length of the pole support. A plurality of apertures are disposed along a length of the second tube. At least one aperture is disposed on the first tube. A pin is insertable in the at least one aperture disposed on the first tube and one of the plurality of apertures disposed along the length of the second tube for setting the length of the pole support.

For purposes of this application, terms used to locate elements on the watercraft, such as "front", "back", "rear", "left", "right", "up", "down", "above", and "below", are as they would normally be understood by a rider of the watercraft in a forwardly facing, driving position.

Embodiments of the present invention each have at least one of the above-mentioned aspects, but do not necessarily have all of them.

Additional and/or alternative features, aspects, and advantages of the embodiments of the present invention will become apparent from the following description, the accompanying drawings, and the appended claims.

BREF DESCRIPTION OF THE DRAWINGS

For a better understanding of the present invention, as well as other aspects and further features thereof, reference is made to the following description which is to be used in conjunction with the accompanying drawings, where:

DETAILED DESCRIPTION OF THE INVENTION

Although the present invention is being described herein with respect to a stand-up personal watercraft, it is contemplated that the present invention could also be used on other types of personal watercraft having a pivoting pole.

Figure 1A:
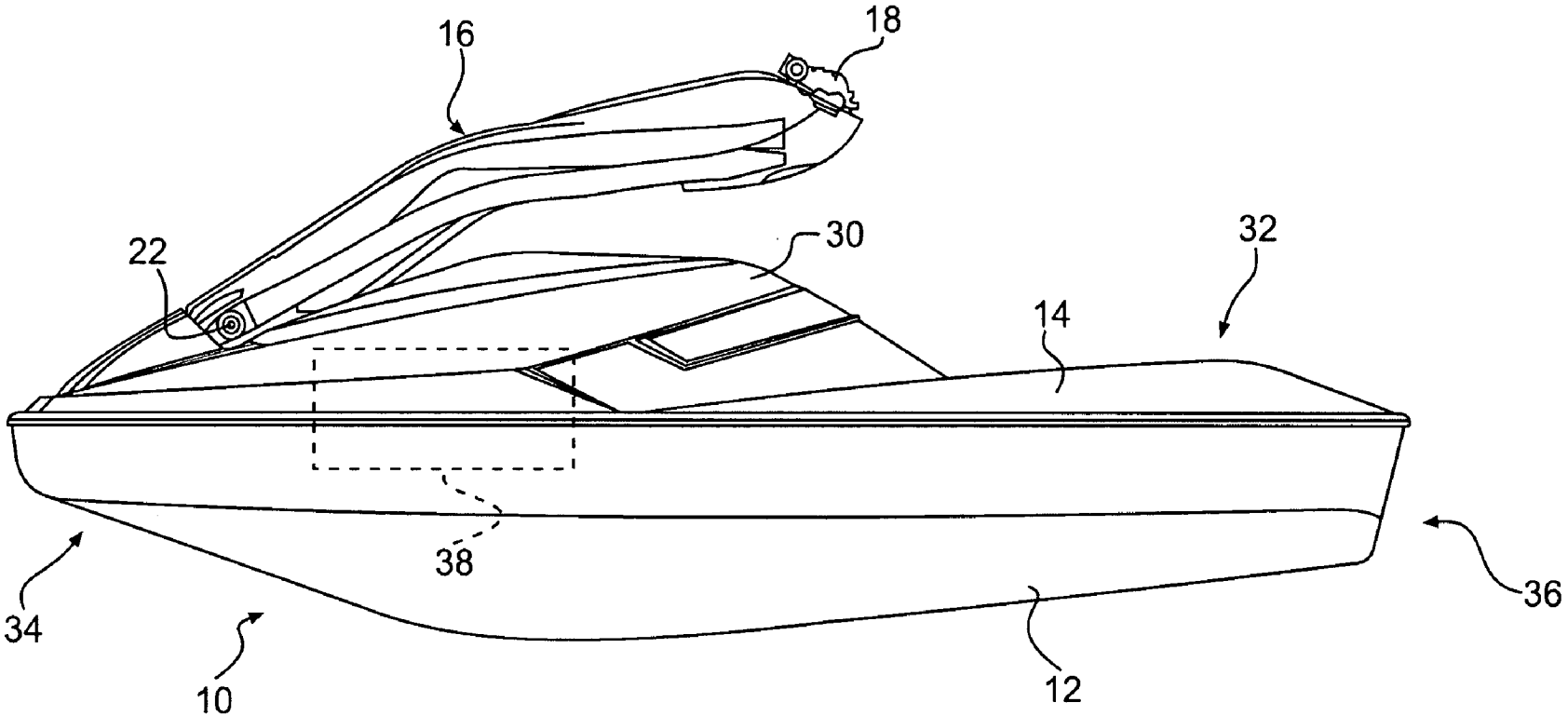
FIG. 1A is a schematic side elevation view of a personal watercraft of the present invention with the pole support removed.

As seen in FIG. 1A, the personal watercraft 10 has a hull 12 and a deck 14 disposed on the hull 12. The forward portion of the personal watercraft 10 is referred to as the bow 34 and the rearward portion is referred to as the transom 36. An engine 38 is disposed in the space between the hull 12 and the deck 14. The engine 38 powers a jet pump unit (not shown) to provide thrust to the personal watercraft 10. It is contemplated that other types of propulsion, such as propellers, could be used. A standing surface 32 is provided on the deck 14 for a rider to stand or kneel on while operating the personal watercraft 10. A pole 16 is pivotally connected to the deck 14. The pole 16 has a forward portion and a rearward portion. The forward portion is the portion of the pole 16 which extends from the half point of the pole 16 to the front end of the pole 16. The rearward portion is the portion of the pole 16 which extends from the half point of the pole 16 to the rear end of the pole 16. The forward portion of the pole 16 is pivotally connected to pivot 22. The pivot 22 defines an horizontal axis 24 about which the pole 16 pivots. A steering assembly 18 having handlebars 20 is connected to the rearward portion of the pole 16. The handlebars 20 can be turned by a rider of the personal watercraft 10 to turn a nozzle (not shown) which redirects the flow of water coming from the jet pump unit, thus steering the personal watercraft 10. It is contemplated that steering could also be achieved by having the handlebars controlling the movement of a rudder. A removable engine cover 30 is disposed on the deck 14 above the engine 38 and below the pole 16. By removing the engine cover 30, the engine 38 can be accessed.

Figure 1B:
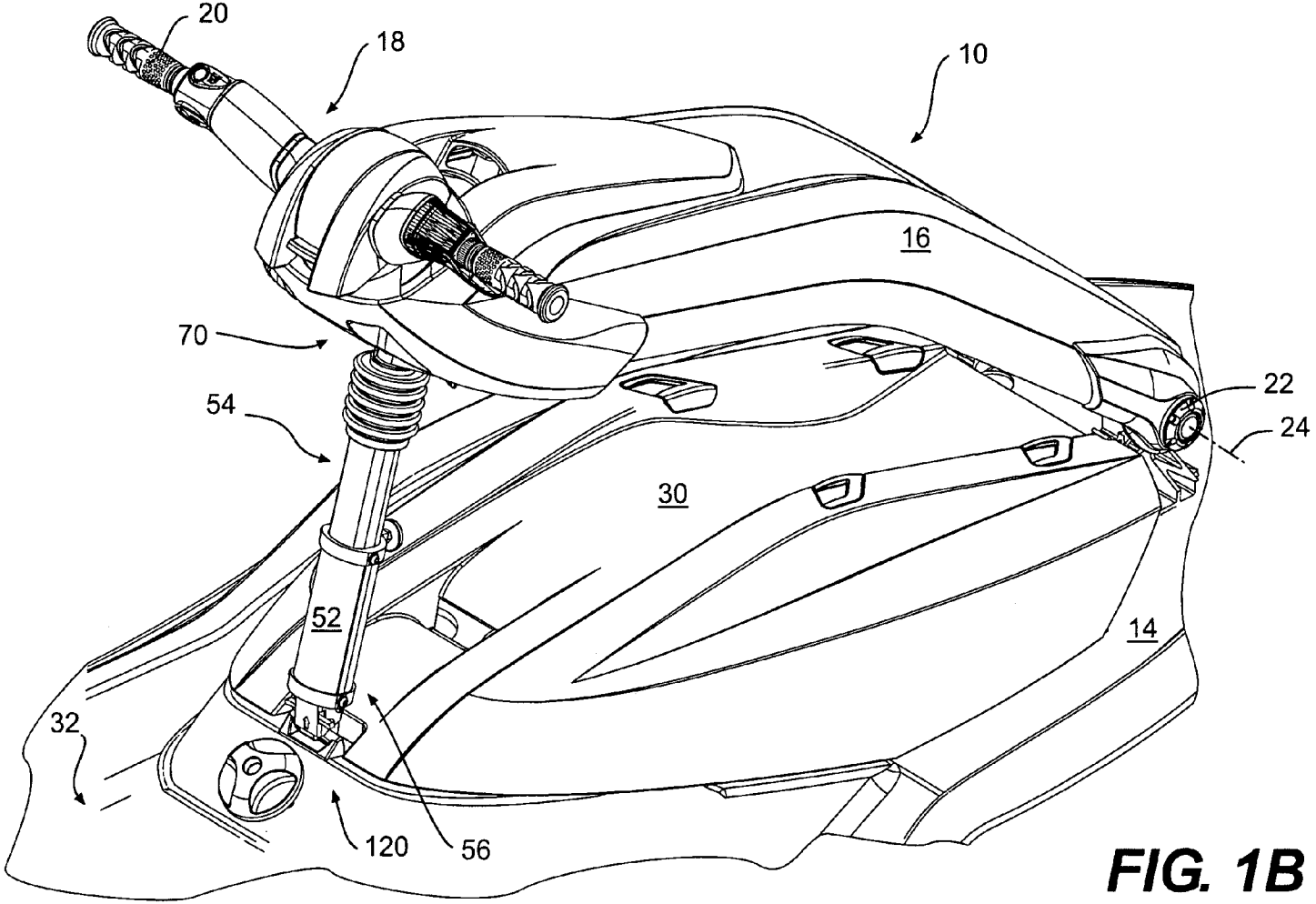
FIG. 1B is a perspective view, taken from a rear, right side, of a close-up of the pole with the pole support installed on the personal watercraft of FIG. 1A.
Figure 2:
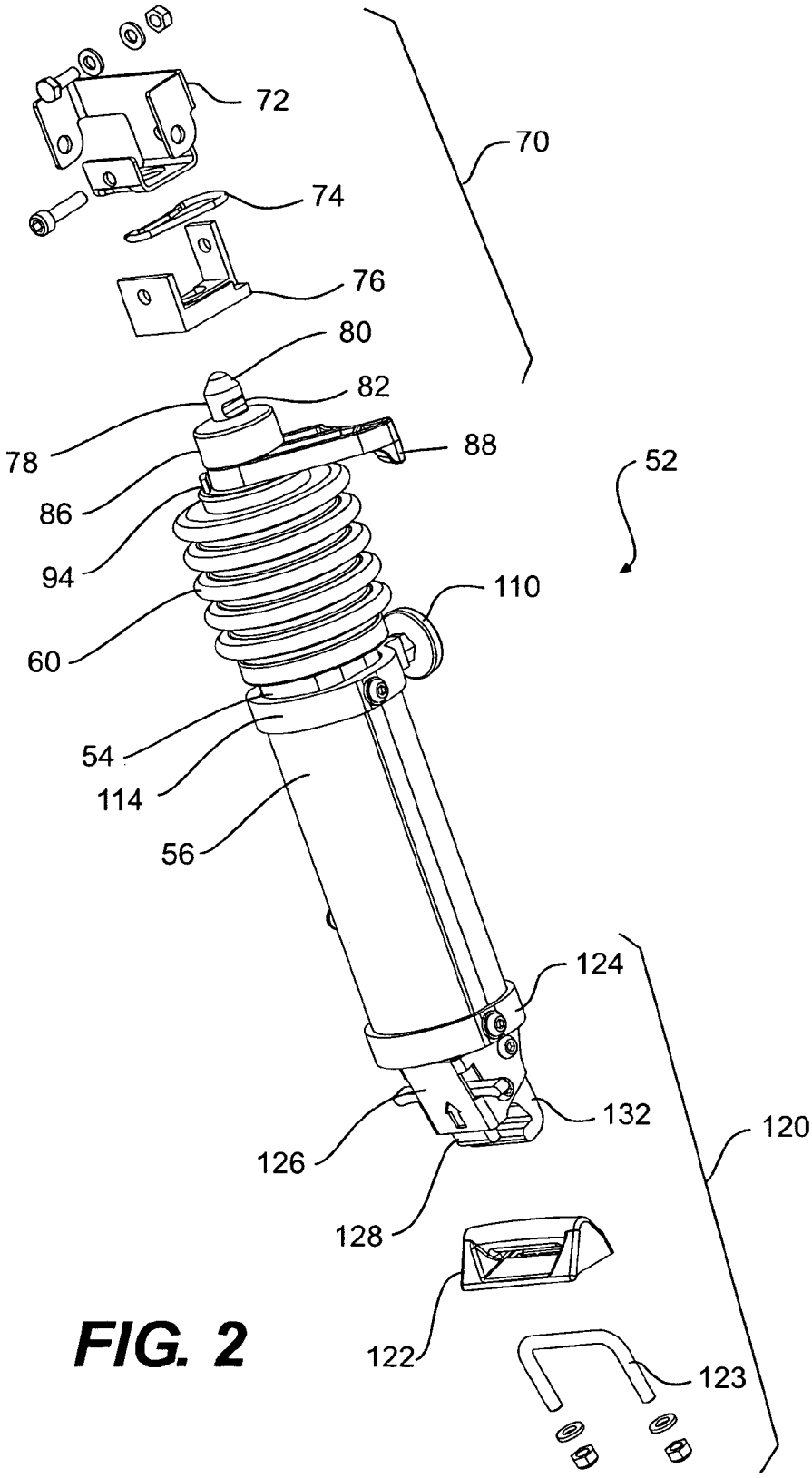
FIG. 2 is a partial exploded view of a pole support and latches of the present invention.

FIG. 1B illustrates the personal watercraft 10 with a pole support 52 connected at an upper end thereof to the rearward portion of the pole 16 and at the lower end thereof to the deck 14, thus supporting the rearward portion of the pole 16 above the deck 14. The lower end of the pole support 52 is connected to the deck 14 in its preferred position rearward of the engine cover 30. The lower end of the pole support 52 is also connected to the deck 14 in its preferred position forward of the standing surface 32. The pole support 52 consists of an upper tube 54 which can slide inside a lower tube 56 to permit the length of the pole support 52 to be adjusted in order to accommodate different sizes of riders, as will be discussed in greater detail below.

The positions of the connections of the pole support 52 to the pole 16 and the deck 14 are preferably selected such that the pole support 52 remains generally vertical, as seen from a side elevation view of the personal watercraft 10 when it is level, regardless of the position of the pole 16 (as determined by the length of the pole support 52). In the illustrated embodiment, as the pole support 52 is lengthened or shortened in order to raise or lower the pole 16 respectively, the pole support 52 will deviate slightly from the vertical, however forces being applied to the pole support 52 will have a greater vertical component. Therefore, positioning the connections of the pole support 52 in such a way provides sufficient support of the pole 16 regardless of the length of the pole support.

The pole support 52 is preferably latched to the pole 16 and the deck 14 to permit easy installation and removal of the pole support 52. The upper end of the pole support 52 is latched to the pole 16 using an upper latch 70, the details of which will be discussed in greater detail below. The lower end of the pole support 52 is latched to the deck 14 using a lower latch 120, the details of which will be discussed in greater detail below. Latches 70 and 120 can preferably be latched and unlatched without the use of tools to further facilitate the installation and removal of the pole support 52.

Turning now to FIGS. 2 to 5, the pole support 52 has, as discussed above, an upper tube 54 which can slide inside a lower tube 56 to permit the length of the pole support 52 to be adjusted. It is contemplated that the upper tube 54 could also slide over the lower tube 56. The tubes 54, 56 are aluminium extrusions in order to be light and rust resistant. It is contemplated that the tubes 54, 56 could be made of other materials, such as plastic. A plurality of apertures 116 are disposed along a length of the upper tube 54. An aperture 118 is disposed on the lower tube 56. The length of the pole support 52 can be adjusted by sliding the upper tube 54 inside the lower tube 56 to align one of the apertures 116 corresponding to a desired length of the pole support 52 with the aperture 118 and inserting a pin 112 in the two apertures 116, 118 to set the length. A knob 110 is (preferably) connected to the end of the pin 112 to facilitate handling of the pin 112. The apertures 116, 118 are (preferably) disposed on a side of the pole support 52 facing a bow 34 of the personal watercraft 10 so that the pin 112 and knob 110 are less likely to interfere with a rider. The tubes 54, 56 are (preferably) shaped such that the upper tube 54 cannot rotate inside the lower tube 56 to facilitate the alignment of the apertures 116 with the aperture 118. A bracket 114 having a passage therein is connected to the lower tube 56 such that the passage is aligned with the aperture 118. The passage in the bracket 114 provides support to the pin 112 when it is inserted in the apertures 116, 118.

Figure 4:
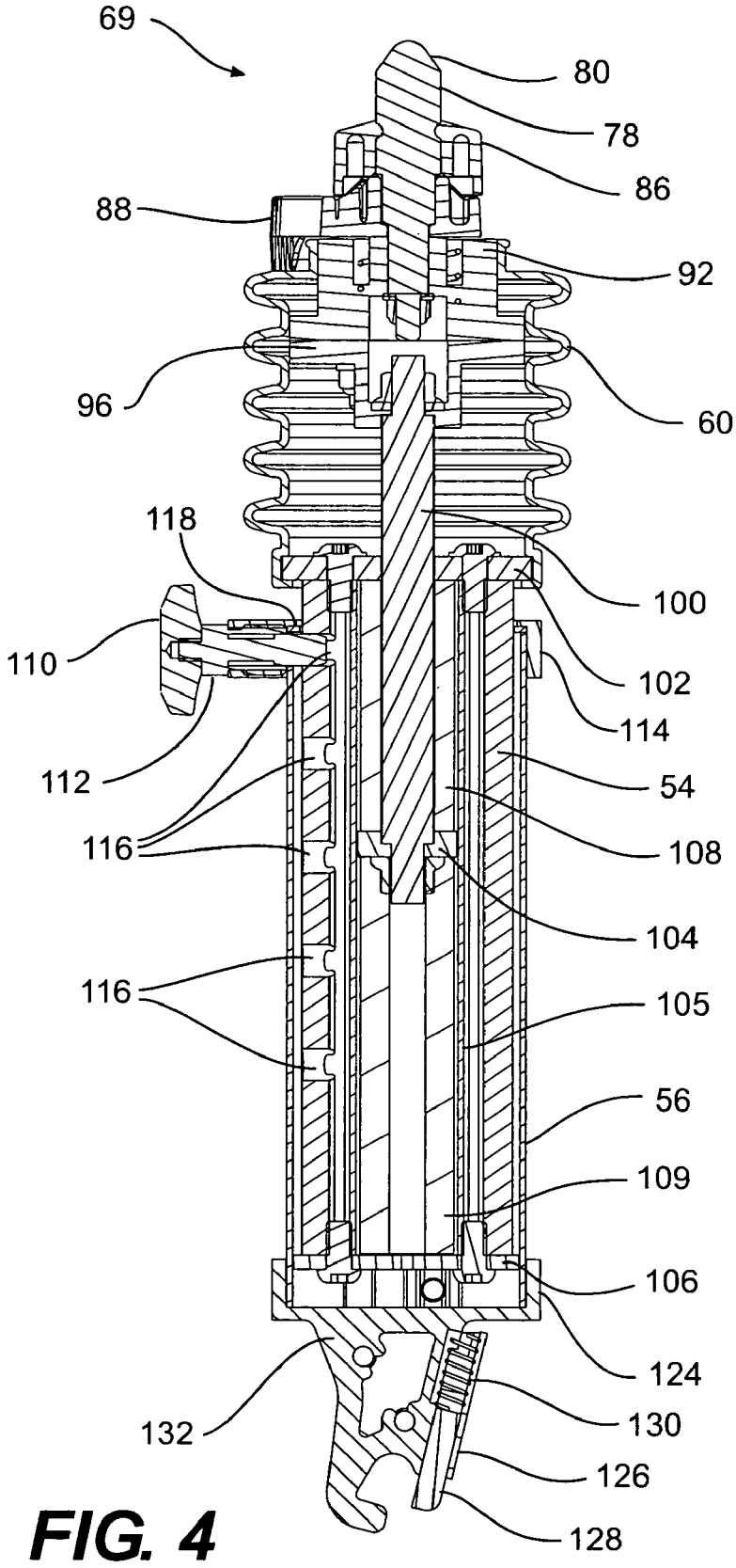
FIG. 4 is a cross-sectional view taken through a center of the pole support of FIG. 2 with the pole support adjusted to a lowered position.
Figure 5:
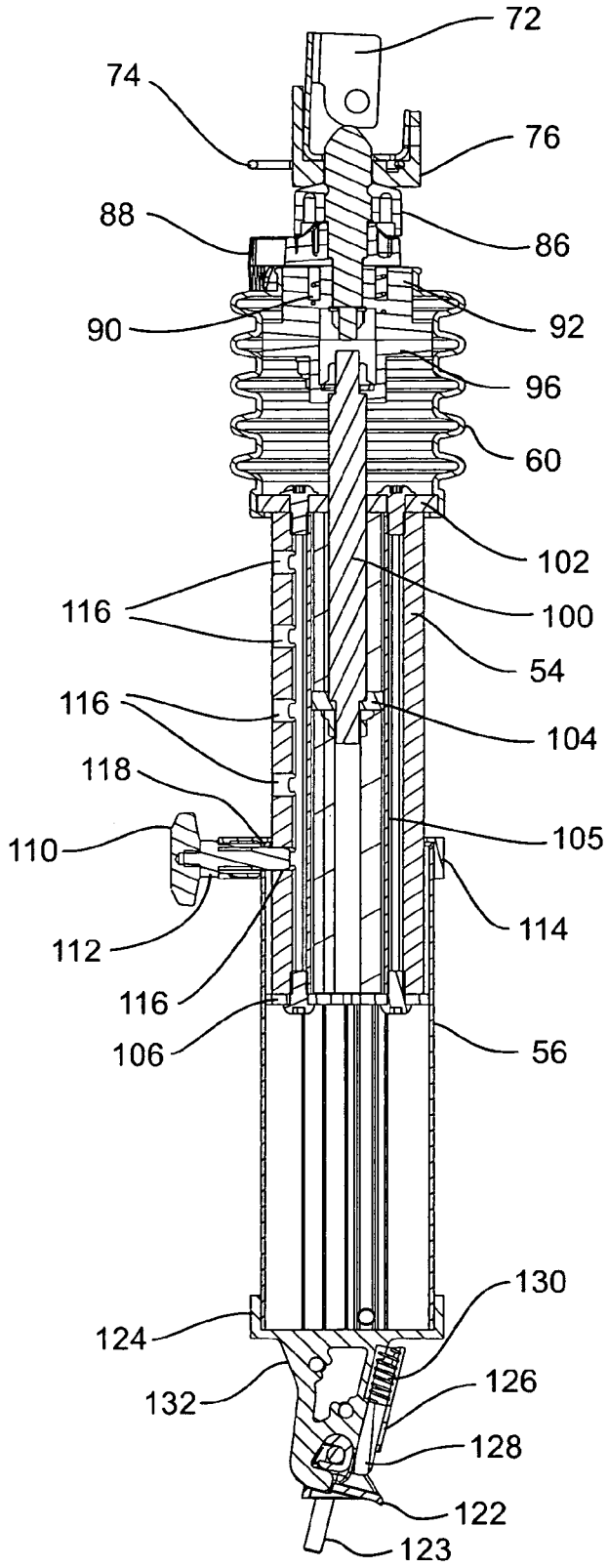
FIG. 5 is a cross-sectional view taken through a center of the pole support and latches of FIG. 2 with the pole support adjusted to a raised position and being latched to the latches.

As seen in FIGS. 4 and 5, the upper tube 54 has five apertures 116, thus providing five possible length adjustments to the pole support 52. It is contemplated that more or less apertures 116 could be provided depending on the desired degree of adjustment of the length of the pole support 52. It is also contemplated that additional apertures could be disposed along the length of the lower tube 56 (and preferably having a distance therebetween which is different from the distance between the apertures 116) in order to provide further adjustment. FIG. 4 illustrates the pole support 52 in its shortest position, which is achieved by inserting the pin in the aperture 118 and the uppermost aperture 116. FIG. 5 illustrates the pole support 52 in its longest position, which is achieved by inserting the pin in the aperture 118 and the lowermost aperture 116. Since the pole support 52 can support the pole 16 at different distances above the deck 14, the pole support 52 can accommodate various sizes of riders.

The pole support 52 is preferably provided with a damper to absorb some of the load being applied by the rider to the pole support 52 via the pole 16, because of waves for example. In a preferred embodiment, a rod 100, used to attach the pole support 52 to the upper latch 70, extends partially inside the center of an inner tube 105 disposed inside and forming part of upper tube 54. A plate 104 is attached to the lower end of the rod 100. A first polymeric damper 108 is placed inside the inner tube 105 above the plate 104 and a second polymeric damper 109 is place inside the inner tube 105 below the plate 104. The first and second polymeric dampers 108, 109 are held inside the inner tube 105 by plates 102 and 106 which are fastened to the upper end and lower end of the upper tube 54 respectively. By sandwiching the plate 104 between the two polymeric dampers 108, 109, the rod 100, and therefore the pole 16, are allowed some vertical movement. The second polymeric damper 109 is (preferably) made of a harder material than the first polymeric damper 108 to provide a different resistance to downwardly applied loads than to upwardly applied loads. The polymeric dampers 108, 109 are (preferably) made of a buoyant material to permit the pole support 52 to float should it fall in water. It is also contemplated that other types of damper, such as a hydraulic damper, could be used.

Figure 3:
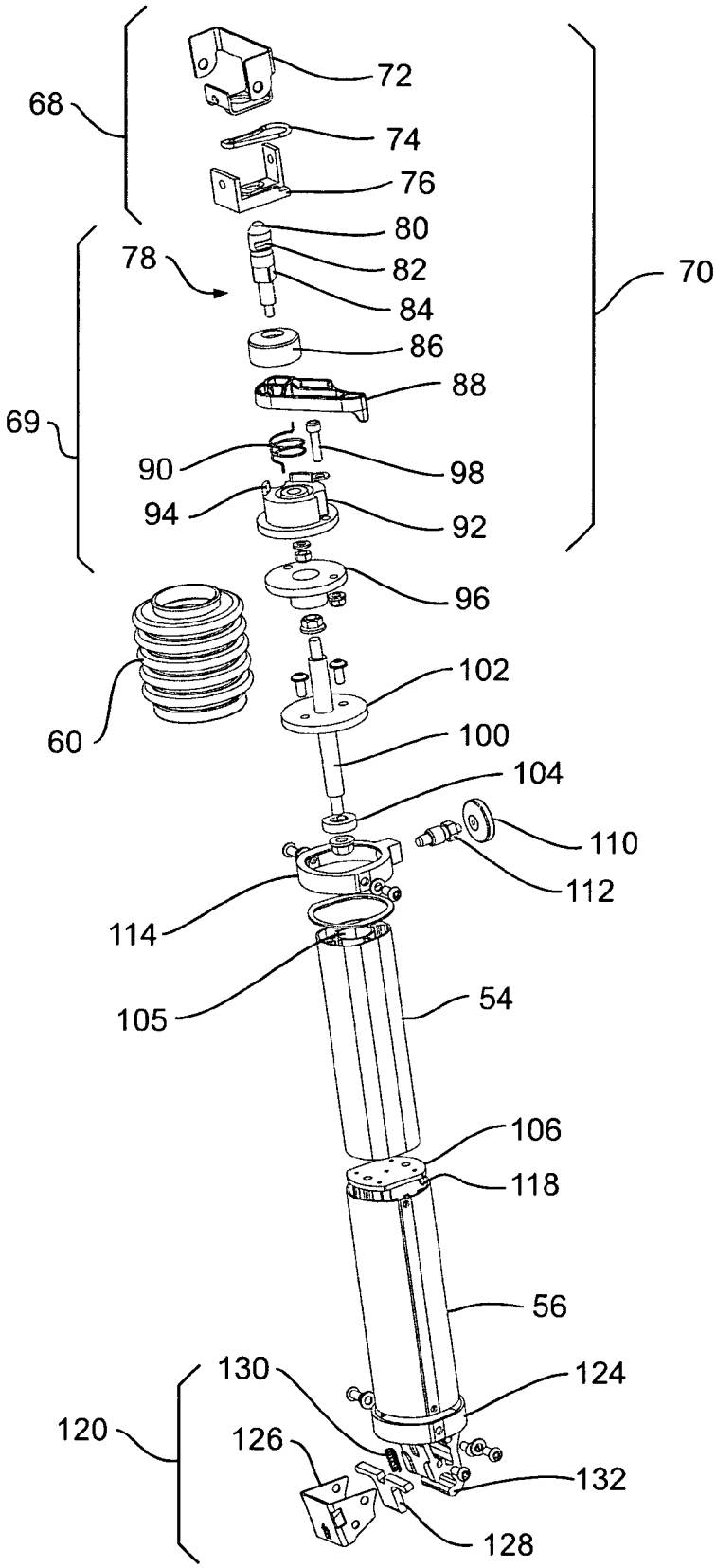
FIG. 3 is an exploded view of the pole support and latches of FIG. 2.
Figure 6:
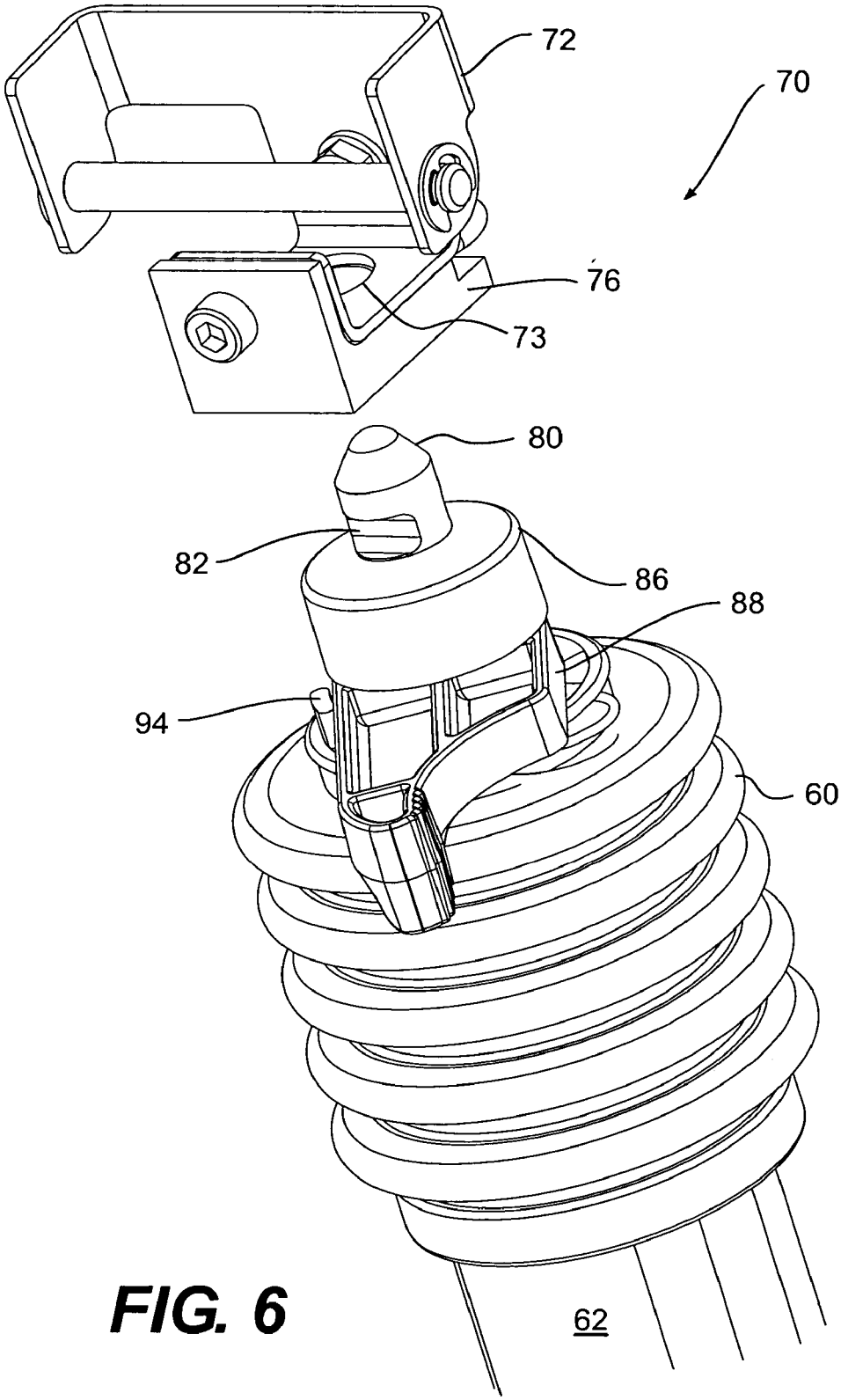
FIG. 6 is a close-up view of an upper latch for the pole support of FIG. 2 in an unlatched position.
Figure 7:
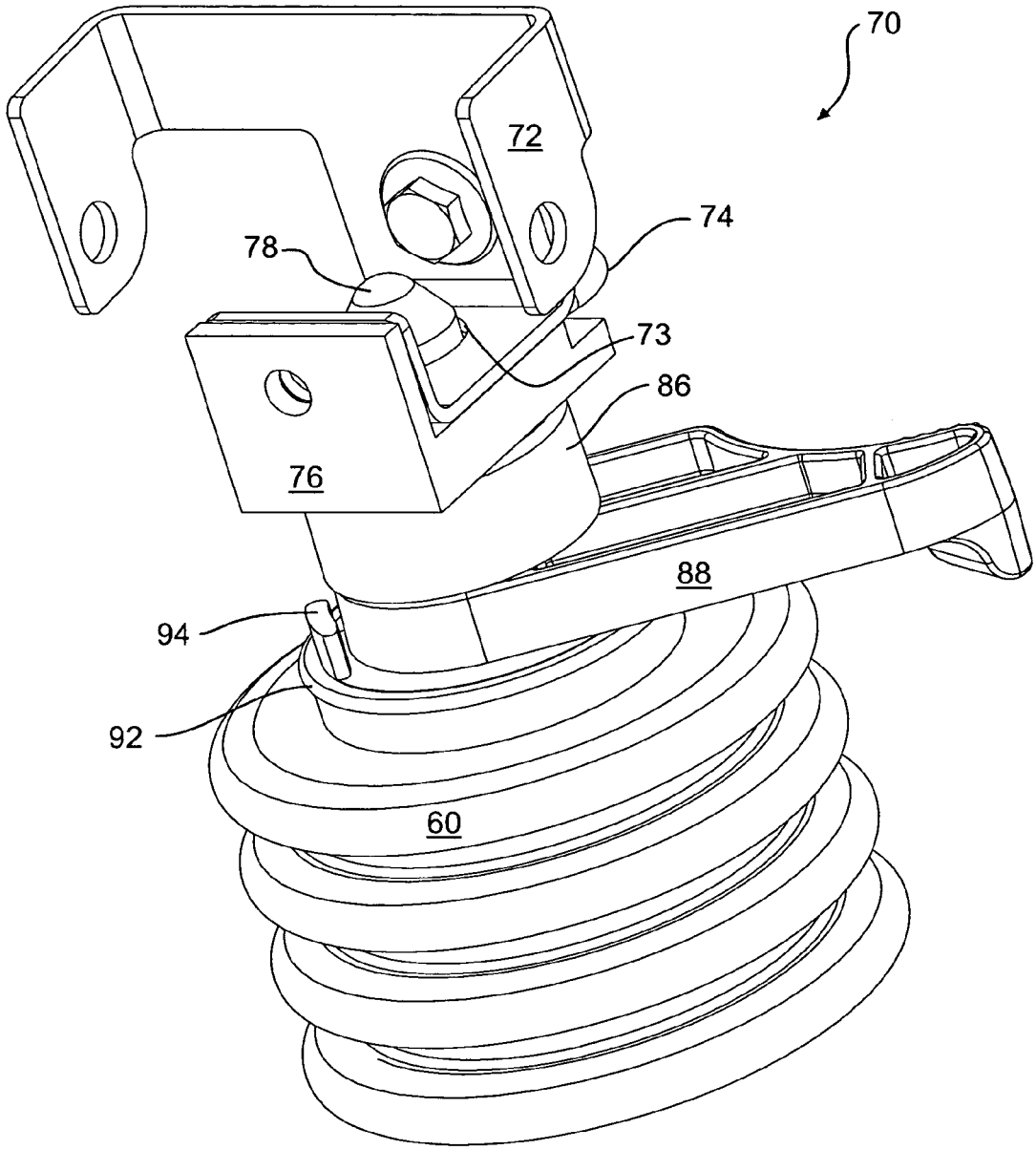
FIG. 7 is a close-up view of the upper latch in a latched position.
Figure 8:
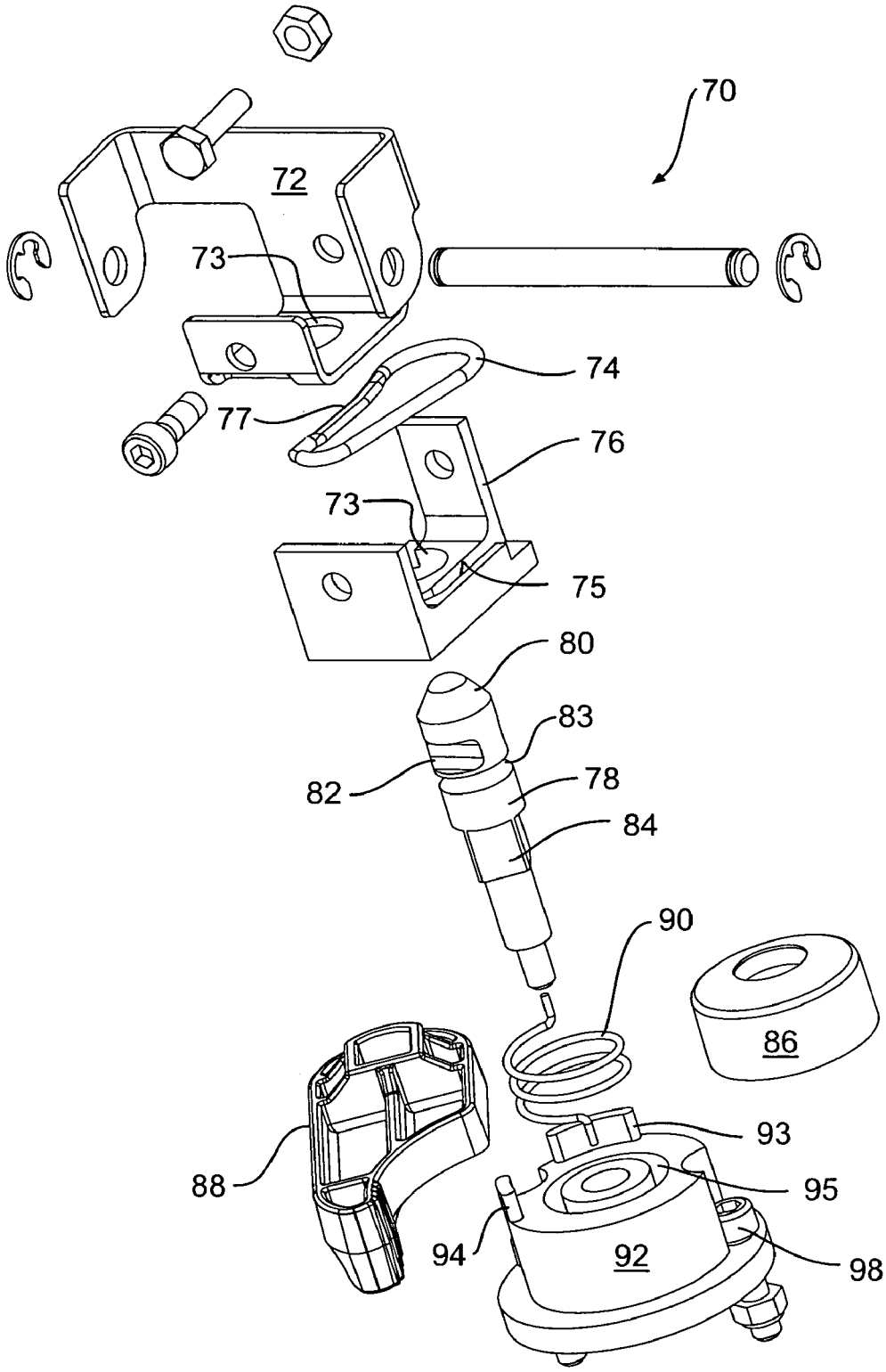
FIG. 8 is an exploded view of the upper latch.

The upper latch 70 used to connect the pole support 52 to the pole 16 has a first portion 69 connected to the upper tube 54 and a second portion 68 connected to the bottom side of the pole 16. As best seen in FIGS. 3 and 8, a connector 96 is disposed on the rod 100 above the plate 102 and is held in place by a nut. The first portion 69 of the upper latch 70 has a lever holder 92 fastened onto the connector 96 by fasteners 98. A bellows 60 extends from the lever holder 92 to the upper end of the upper tube 54 to protect the components inside of it from water. A lever 88 is placed over the lever holder 92. The lever 88 can be manually rotated between a first position (as shown in FIG. 7) where the lever 88 abuts first stopper 93 disposed on lever holder 92, and a second position (as shown in FIG. 6) where the lever 88 abuts a second stopper 94 disposed on lever holder 92. A spring 90 disposed in a recess 95 of the lever holder 92 biases the lever 88 towards the first stopper 93. A stem 78 is inserted through openings in the lever 88 and the lever holder 92. Prior to fastening the lever holder 92 to the connector 96, a nut is fastened on the bottom of the lever holder 92 onto the end of the stem 78 to hold the stem 78, lever 88, spring 90, and lever holder 92 together. The stem 78 has a polygonal section 84 which fits inside a similarly shaped opening in the lever 88, such that when the lever 88 is rotated, the stem 78 rotates with it for reasons which will be explained below. The upper end of the stem 78 has a conical portion 80 and notches 82 (only one of which is visible in the figures) below the conical portion 80, also for reasons which will be explained below. A cover 86 snap fits in a groove 83 located on the periphery of the stem 78. The cover 86 prevents the stem 78 from going too far inside the second portion 68 of the latch 70, as will be explained in greater detail below.

The second portion 68 of the latch 70 has a bracket 72 used to fasten it to the bottom portion of the pole 16. A stem receiving member 76 has a groove 75 in it to receive a spring 74 in the form of a loop therein. The stem receiving member 76 is fastened to the bracket 72. This causes the spring 74 to be held between the stem receiving member 76 and the bracket 72. The bracket 72 and the stem receiving member 76 have coaxial openings 73 to receive the stem 78. The spring 74 has a portion 77 which extends inside the perimeter of these opening 73 in order to engage a notch 82 of the stem 78 as described below.

In order to latch the upper end of the pole support 52 onto the pole 16, the stem 78 first needs to be aligned with the openings 73. Then, the pole 16 is pushed down causing the conical portion 80 of the stem 78 to push the portion 77 of the spring 74 outwardly until a notch 82 of the stem 78 is vertically aligned with the spring 74. The cover 86 prevents the stem 78 from going too far up inside the second portion 68 of the latch 70. At that point, the portion 77 of the spring 74 springs back into the notch 82, capturing the stem 78 inside the second portion 68 of the latch 70, thus latching the upper end of the pole support 52 to the pole 16, as seen in FIG. 7.

In order to unlatch the upper end of the pole support 52 from the pole 16, the lever 88 has to be rotated to the position shown in FIG. 6. This causes the stem 78 to rotate as well. In this position, the portion 77 of the spring 74 is no longer aligned with the notch 82 and is pushed outwardly by a side of the stem 78 adjacent to the notch 82. The stem 78, and therefore the pole support 52, can then be released from the second portion 68 of the latch 70 by lifting the pole 16.

In order to prevent any undesired rotation, and therefore possible unlatching, of the stem 78, the plate 104 is preferably non-circular in shape and slides inside the complementarily shaped inner tube 105. Since the plate 104 cannot rotate inside the inner tube 105, the rod 100 to which it is connected, and therefore the connector 96 and lever holder 92 which are connected to the rod 100, cannot rotate either. Therefore, the stem 78 can only be rotated, and the pole support 52 unlatched from latch 70, by the lever 88.

Figure 9:
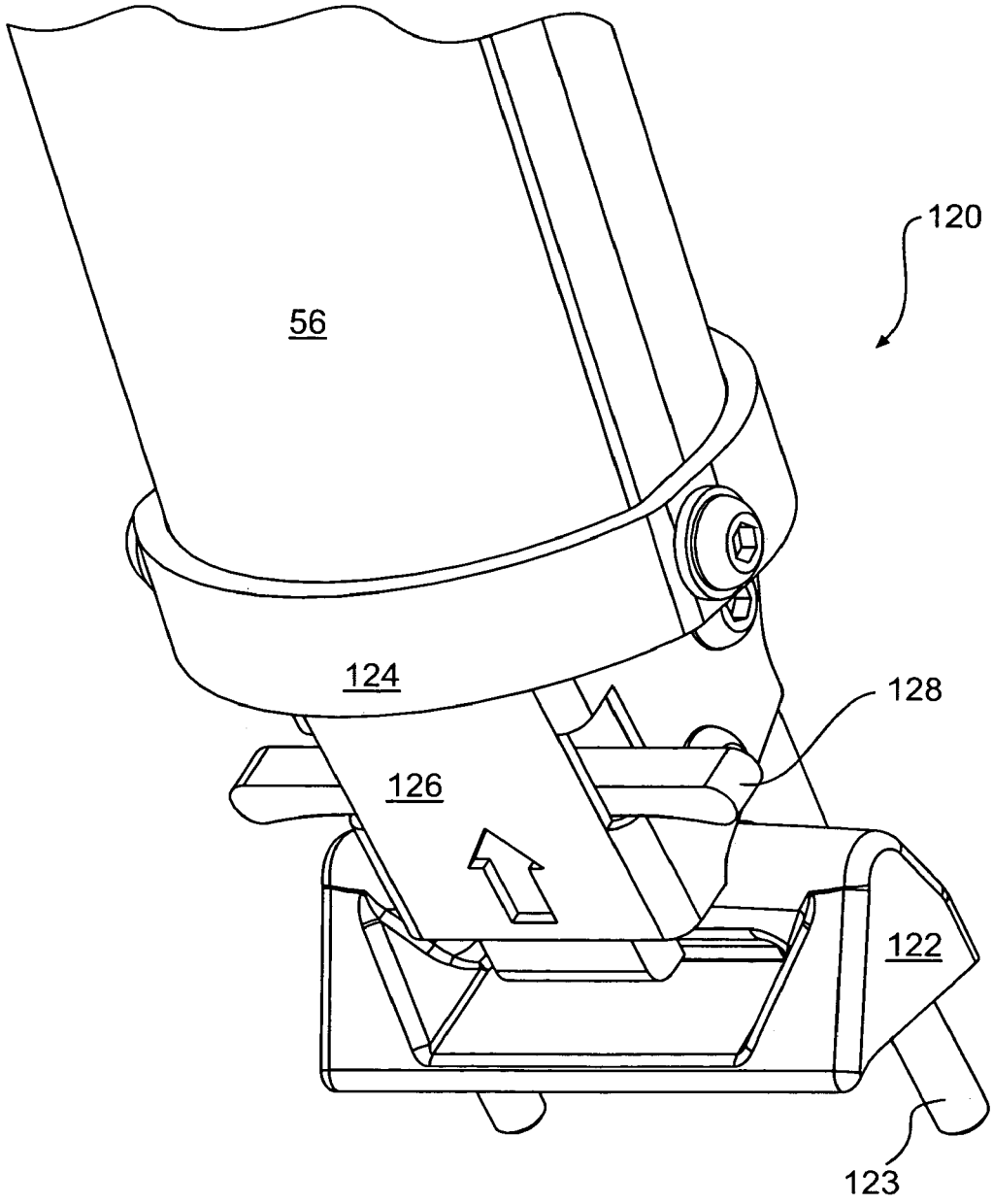
FIG. 9 is a close-up view of a lower latch for the pole support of FIG. 2 in a latched position.
Figure 10:
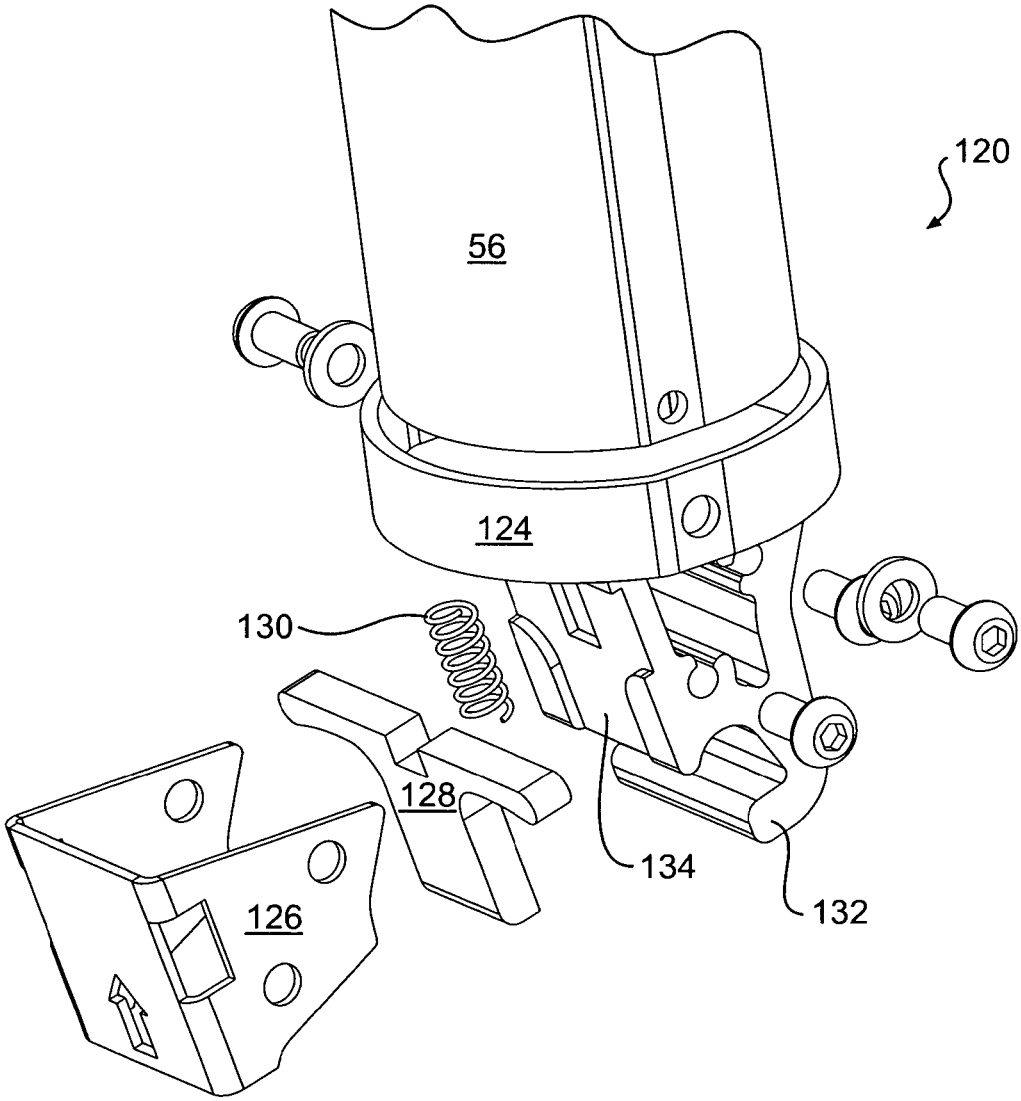
FIG. 10 is an exploded view of the lower latch.

Turning now to FIGS. 9 and 10, the lower latch 120 has a hooked member 132 connected to the lower tube 56 via a bracket 124. The hooked member 132 and bracket 124 are preferably integrally formed together. A T-shaped slider 128 is disposed inside a recess 134 of the hooked member 132. A spring 130 is disposed above the slider 128 to bias the slider 128 downwardly. A cover 126 is connected to the hooked member 132 and maintains the T-shaped slider 128 and the spring 130 in position in the recess 134. As seen in FIG. 9, the upper portions of the T-shaped slider 128 extend through openings in the cover 126. These portions can be grabbed to lift the T-shaped slider 128. A bracket 122 is placed over a hook 123 (FIG. 2) which is attached to the deck 14. The hook 123 is preferably made of metal to provide sufficient strength to the latch 120.

To latch the pole support 52 to the deck 14, the T-shaped slider 128 is first lifted. The hooked member 132 is then hooked over the bracket 122 and hook 123. The T-shaped slider 128 is then released and the spring 130 biases the T-shaped slider 128 back to its initial position as shown in FIG. 9, thus capturing the bracket 122 and hook 123 between the T-shaped slider 128 and the hooked member 132 (see FIG. 5).

To unlatch the pole support 52 from the deck 14, the T-shaped slider 128 needs to first be lifted and the hooked member 132 unhooked from the bracket 122 and hook 123.

When installing the pole support 52 onto the personal watercraft 10, the pole support 52 is preferably first latched to the deck 14 by using latch 120, and then latched to the pole 16 by using latch 70. When removing the pole support 52 from the personal watercraft 10, the pole support 52 is preferably first unlatched from the pole 16 and then unlatched from the deck.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A personal watercraft comprising:

a hull;

a deck disposed on the hull;

an engine disposed between the hull and the deck to power the watercraft;

a pole having a forward portion and a rearward portion, the forward portion of the pole being pivotally connected to the deck about a substantially horizontal axis;

handlebars being operatively connected to the rearward portion of the pole for steering the watercraft; and a pole support to support the rearward portion of the pole above the deck, the pole support comprising:

a first end connected to the pole;

a second end connected to the deck;

a first tube;

a second tube, one of the first tube and the second tube sliding inside the other of the first tube and the second tube to permit adjustment of a length of the pole support;

a plurality of apertures disposed along a length of the second tube;

at least one aperture disposed on the first tube; and a pin insertable in the at least one aperture disposed on the first tube and one of the plurality of apertures disposed along the length of the second tube for setting the length of the pole support.

2. The personal watercraft of claim 1, wherein the second tube slides inside the first tube to permit adjustment of the length of the pole support.

3. The personal watercraft of claim 2, wherein the second end of the pole support is on the first tube.

4. The personal watercraft of claim 1, wherein the pole support further comprises a damper.

5. The personal watercraft of claim 4, wherein the damper comprises an elastomeric material disposed inside one of the first tube and the second tube.

6. The personal watercraft of claim 1, wherein the apertures and the pin are disposed on a side of the pole support generally facing toward a bow of the personal watercraft.

7. The personal watercraft of claim 1, further comprising:

a first latch for connecting the first end of the pole support to the pole; and a second latch for connecting the second end of the pole support to the deck.

* * * * *